US006268698B1

(12) United States Patent
Scholz

(10) Patent No.: US 6,268,698 B1
(45) Date of Patent: Jul. 31, 2001

(54) CAPACITIVE GLOW STARTING OF HIGH INTENSITY DISCHARGE LAMPS

(75) Inventor: John A. Scholz, Georgetown, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/205,581

(22) Filed: Dec. 4, 1998

(51) Int. Cl.[7] ..... H01J 61/04
(52) U.S. Cl. ..... 313/631; 313/493; 313/634
(58) Field of Search ..... 313/493, 575, 313/574, 594, 607, 623, 624, 631, 634

(56) References Cited

U.S. PATENT DOCUMENTS 5,323,091 * 6/1994 Morris ..... 313/634

FOREIGN PATENT DOCUMENTS 0313027 4/1989 (EP) ..... H01J/61/54
0722184 7/1996 (EP) ..... H01J/61/54
2061957 3/1990 (JP) ..... H01J/61/54
2061958 3/1990 (JP) ..... H01J/61/54

* cited by examiner

*Primary Examiner*—Vip Patel
(74) *Attorney, Agent, or Firm*—William H. McNeill

(57) ABSTRACT

An hermetically sealed arc tube which comprises a hollow body having oppositely disposed ends aligned along a longitudinal axis and containing an arc generating and sustaining medium therein. An electrode is positioned in each end of the hollow body and an ionization zone is positioned adjacent to one of the ends and is a part thereof. The ionization zone is exposed to an atmosphere different than the arc generating and sustaining medium.

8 Claims, 3 Drawing Sheets

CAPACITIVE GLOW STARTING OF HIGH INTENSITY DISCHARGE LAMPS

TECHNICAL FIELD

This invention relates to starting aids and more particularly to starting aids for high intensity discharge lamps. It has particular application to high intensity discharge lamps fabricated from quartz.

BACKGROUND ART

Starting low wattage (20w to 70w) or even higher wattage high intensity discharge lamps often requires the use of glow bottles in addition to a ballast that supplies a high voltage pulse to start the lamp. The glow bottles that have been suggested and employed contain a partial pressure (<1 atmosphere) of argon or nitrogen or other gas mixtures. They may even include a partial pressure of mercury. These glow bottles contain an additional electrical lead that facilitates the "glow" or ionization of the contained gases when a sufficient potential is applied thereto. The glass vessel of the glow bottle must also be in close proximity to a lead-in of the opposite potential for the glow or ionization to occur.

The use of glow bottles works well in normal environments; however, their use becomes a problem as the size of the lamps gets smaller. For example, there is insufficient room in the neck region of a PAR20 lamp jacket to permit glow bottle placement. Also, such placement would encounter additional problems associated with distortion of the projected image or light beam if the glow bottle were placed in an area that interferes with the reflector surface or with the lensing optics of the lamp.

One solution to the problem that has been suggested employs radioactive krypton 85 as the arc tube gas fill; however, that solution requires the expense of extra filtering and hazardous material licenses.

DISCLOSURE OF INVENTION

It is, therefore, an object of the invention to obviate the disadvantages of the prior art.

It is another object of the invention to enhance the starting of high intensity discharge lamps.

It is another object of the invention to provide a starting aid for high intensity discharge lamps that does not employ hazardous materials These objects are accomplished, in one aspect of the invention, by the provision of an hermetically sealed arc tube which comprises a hollow body having oppositely disposed ends aligned along a longitudinal axis and containing an arc generating and sustaining medium therein. An electrode is positioned in each end of the hollow body and an ionization zone is positioned adjacent to one of the ends and is a part thereof. The ionization zone is exposed to an atmosphere different than the arc generating and sustaining medium.

In a further embodiment there is provided an arc tube for a discharge lamp comprising: an hermetically sealed hollow body containing an arc generating and sustaining medium therein and having first and second ends; an electrode receiving seal extending from each end; an electrode structure positioned in each of said seals, each of said electrode structures comprising a proximal electrode end projecting into the interior of said hollow body, a distal end projecting exteriorly of said seal, and an intermediate section therebetween, said intermediate section being sealed in said seal in an hermetic manner; and a seal extension attached to a first one of said seals and extending in a direction away from said hollow body, said extension comprising a tubular segment substantially surrounding said distal end of said electrode projecting from said seal at said first end; and a starting aid comprising an electrode adjunct affixed to said distal end of said electrode projecting from said first end within said tubular segment and an electrically conducting member surrounding said tubular segment and being electrically connected to the distal end of the electrode structure positioned in said second end.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
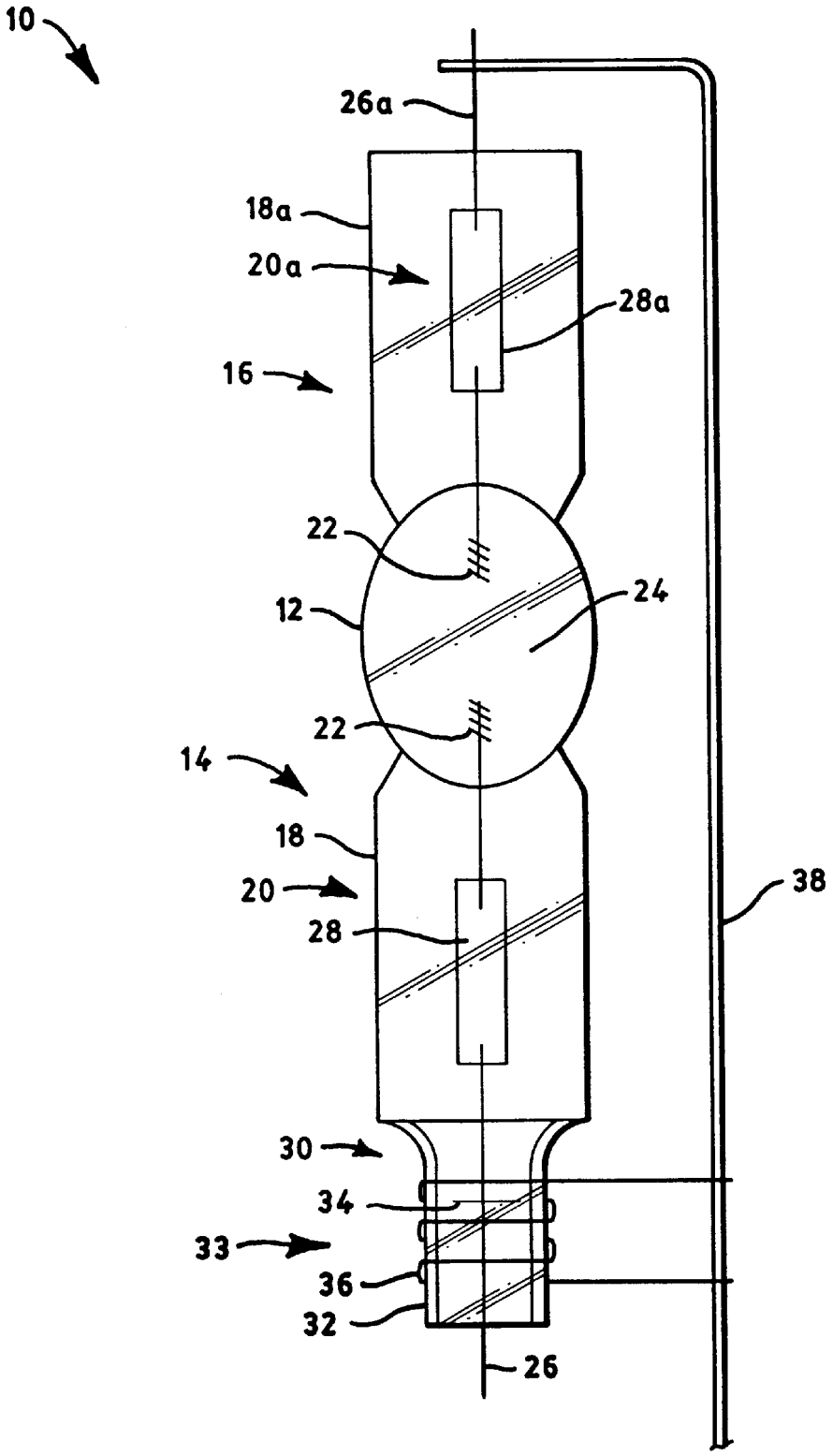
FIG. 1 is an elevational view of an arc tube for a high intensity discharge lamp using an embodiment of the invention.

Referring now to the drawings with greater particularity, there is shown in FIG. 1 an arc tube 10 for a discharge lamp. The arc tube comprises an hermetically sealed hollow body 12 containing an arc generating and sustaining medium therein and having first and second ends, 14, 16. Electrode receiving seals 18, 18*a*, extend, respectively, from the ends, the seals 18, 18*a*, in this instance, comprising press seals. An electrode structure 20 is positioned in seal 18 and an electrode structure 20*a* is positioned in seal 18*a*. Each electrode structure comprises a proximal electrode end 22 that projects into the interior 24 of the hollow body 12. Electrode structure 20 has a distal end 26 that projects exteriorly of the seal 18, and an intermediate section 28. Electrode structure 20*a* has a distal end 26*a* that projects exteriorly of the seal 18*a*, and an intermediate section 28*a*. The intermediate sections are usually formed of a molybdenum ribbon or foil while the proximal and distal ends are generally tungsten, as is known in the art. The hermetic seal is formed between the glass and the molybdenum foil.

A seal extension 30 is attached to one of the ends, for example, first end 14, and comprises a tubular segment 32 substantially surrounding the distal end 26 of electrode structure 20. A starting aid 33 comprises an electrode adjunct 34, affixed to the distal end 26 of the electrode structure 20 within the confines of the tubular segment, and an electrically conducting member 36 surrounding the tubular segment 32. The electrically conducting member 36 is electrically connected to the distal end 26*a* of the electrode structure 20*a* positioned in the second end 16, for example, by connector 38.

In a preferred embodiment of the invention, the electrode adjunct 34 is a piece of 0.015" diameter molybdenum wire positioned so that the ends are in proximity to the internal wall of tubular segment 32 and the electrically conductive member 36 comprises three turns of 0.030" diameter nickel wire. The tubing for the tubular segment 32 is preferably 4.8 mm OD, 3.2 mm ID, leaving a 0.8 mm wall. This configuration creates an ionization zone within the tubular segment

32. When power is applied to the arc tube from a suitable ballast, an instantaneous glow or ionization of the atmosphere within the tubular segment is achieved, this atmosphere being different than the atmosphere within the arc tube and, preferably, is air. The radiation from this ionization helps to start the arc discharge in the arc tube.

Figure 2:
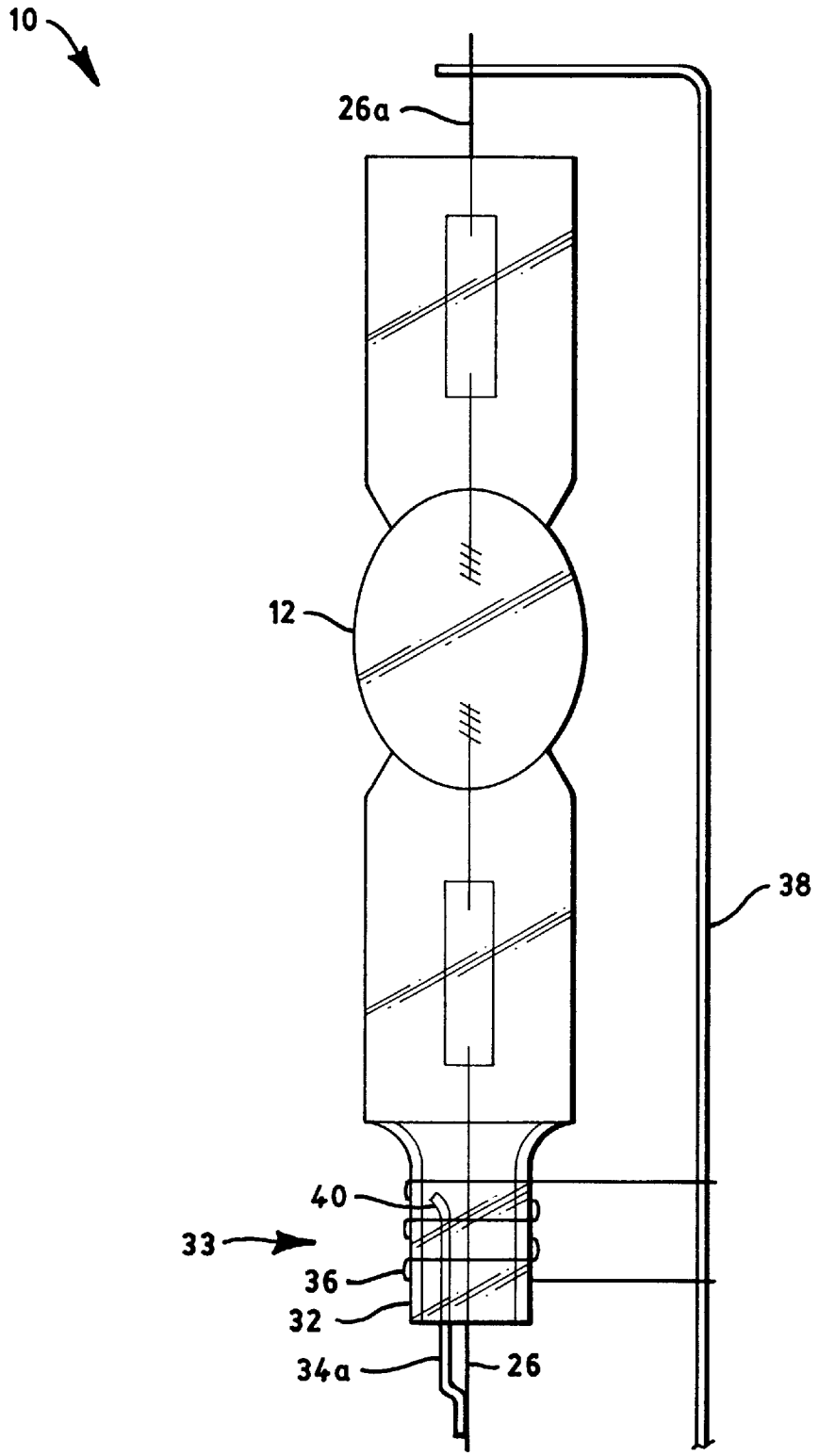
FIG. 2 is a similar view illustrating an alternate embodiment of the invention.

An alternate embodiment of the invention is shown in FIG. 2 wherein the electrode adjunct 34*a* is affixed to the distal end 26 at a location outside of the tubular segment 32 but extends upwardly into the segment. In this instance, the adjunct 34*a* has a termination 40 within the tubular segment, which termination is bent to extend toward the internal surface of the tubular segment.

Figure 3:
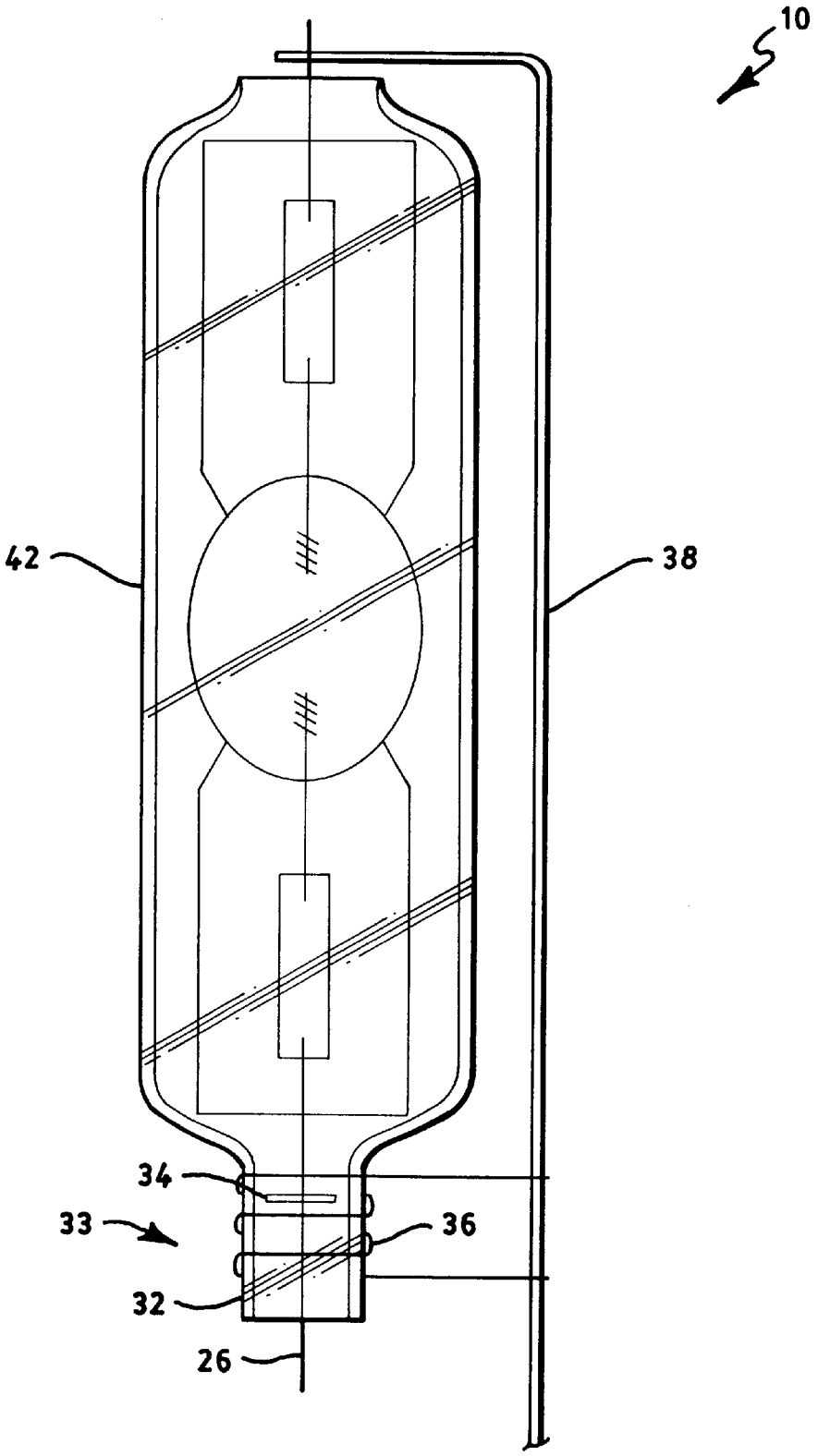
FIG. 3 is a similar view illustrating yet another embodiment of the invention.

Another embodiment of the invention is shown in FIG. 3 wherein the starting aid 33 is incorporated into a shroud 42 that is fixed to the tubular segment 32 or is a part thereof.

While there have been shown and described what are at present considered the preferred embodiments of the invention, it will be apparent to those skilled in the art that various changes and modifications can be made herein without departing from the scope of the invention as defined by the appended claims.

What is claimed is:

1. An arc tube for a discharge lamp comprising: an hermetically sealed hollow body containing an arc generating and sustaining medium therein and having first and second ends; an electrode receiving seal extending from each end; an electrode structure positioned in each of said seals, each of said electrode structures comprising a proximal electrode end projecting into the interior of said hollow body, a distal end projecting exteriorly of said seal, and an intermediate section therebetween, said intermediate section being sealed in said seal in an hermetic manner; and a seal extension attached to a first one of said seals and extending in a direction away from said hollow body, said extension comprising a tubular segment substantially surrounding said distal end of said electrode projecting from said seal at said first end; and a starting aid comprising an electrode adjunct affixed to said distal end of said electrode projecting from said first end within said tubular segment and an electrically conducting member surrounding said tubular segment and being electrically connected to the distal end of the electrode structure positioned in said second end.

2. The arc tube of claim 1 wherein said electrically conducting member comprises multiple turns of wire.

3. An hermetically sealed arc tube comprising; a hollow body having oppositely disposed ends aligned along a longitudinal axis and containing an arc generating and sustaining medium therein; an electrode in either end of said hollow body and an ionization zone positioned adjacent to one of said ends and being a part thereof, said ionization zone being exposed to an atmosphere different than the arc generating and sustaining medium.

4. The arc tube of claim 1 wherein said electrode adjunct comprises a wire extending normal to the said distal end of said electrode.

5. The arc tube of claim 1 wherein said electrode adjunct comprises a wire extending parallel to said distal end of said electrode.

6. The arc tube of claim 5 wherein said electrode adjunct has one end affixed to said electrode and a free second end spaced therefrom.

7. The arc tube of claim 6 wherein said free end points toward and internal wall of said tubular segment.

8. The arc tube of claim 1 wherein said arc tube is surrounded by a shroud and said tubular segment is part of said shroud.

* * * * *